US007314544B2

(12) United States Patent
Murphy et al.

(10) Patent No.: US 7,314,544 B2
(45) **Date of Patent: *Jan. 1, 2008**

(54) ELECTROCHEMICAL SYNTHESIS OF AMMONIA

(75) Inventors: Oliver J. Murphy, Bryan, TX (US); Adrian J. Denvir, Bryan, TX (US); Sorin G. Teodorescu, College Station, TX (US); Kyle B. Uselton, College Station, TX (US)

(73) Assignee: Lynntech, Inc., College Station, TX (US)

( * ) Notice: Subject to any disclaimer, the term of this patent is extended or adjusted under 35 U.S.C. 154(b) by 162 days.

This patent is subject to a terminal disclaimer.

(21) Appl. No.: 11/212,038

(22) Filed: Aug. 25, 2005

(65) Prior Publication Data

US 2006/0049063 A1 Mar. 9, 2006

Related U.S. Application Data

(60) Provisional application No. 60/607,653, filed on Sep. 7, 2004.

(51) Int. Cl.
*C25B 1/00* (2006.01)

(52) U.S. Cl. ..... 205/360; 205/552

(58) Field of Classification Search ..... 205/552, 205/360

See application file for complete search history.

(56) References Cited

U.S. PATENT DOCUMENTS 2,716,670 A 8/1955 Bacon
3,393,098 A 7/1968 Hartner et al.
3,647,415 A 3/1972 Yano et al.
3,753,782 A 8/1973 Beccu et al.

(Continued)

FOREIGN PATENT DOCUMENTS

EP 0 972 855 A1 1/2000

(Continued)

OTHER PUBLICATIONS

"Assessment of Research Needs for Advanced Fuel Cells"; S.S. Penner; Energy, The International Journal; vol. 11, No. ½, 1986.

(Continued)

*Primary Examiner*—Arun S. Phasge
(74) *Attorney, Agent, or Firm*—Jeffrey L. Streets; Streets & Steele

(57) ABSTRACT

A method for the anodic electrochemical synthesis of ammonia gas. The method comprises providing an electrolyte between an anode and a cathode, providing nitrogen and hydrogen gases to the cathode, oxidizing negatively charged nitrogen-containing species and negatively charged hydrogen-containing species present in the electrolyte at the anode to form adsorbed nitrogen species and adsorbed hydrogen species, respectively, and reacting the adsorbed nitrogen species with the adsorbed hydrogen species to form ammonia. Nitrogen and hydrogen gases may be provided through a porous cathode substrate. The negatively charged nitrogen-containing species in the electrolyte may be produced by reducing nitrogen gas at the cathode and/or by supplying a nitrogen-containing salt, such as lithium nitride, into the molten salt electrolyte. Similarly, the negatively charged hydrogen-containing species in the electrolyte may be produced by reducing hydrogen gas at the cathode and/or by supplying a hydrogen-containing salt, such as lithium hydride, into the molten salt electrolyte.

18 Claims, 5 Drawing Sheets

U.S. PATENT DOCUMENTS

| | | | | |
|---|---|---|---|---|
| 4,547,273 | A | 10/1985 | Ayers | |
| 5,071,516 | A | 12/1991 | Furuya | |
| 5,584,981 | A | 12/1996 | Turner | |
| 6,712,950 | B2 * | 3/2004 | Denvir et al. | 205/552 |

FOREIGN PATENT DOCUMENTS

| | | |
|---|---|---|
| JP | 02-054790 | 2/1990 |
| JP | 200247632 | 9/2000 |

OTHER PUBLICATIONS

"Ammonia Synthesis at Atmospheric Pressure"; George Marnellos and Michael Stoukides, SCIENCE, vol. 282, Oct. 2, 1998.

"Electroreduction of Nitrogen to Ammonia on Gas-Diffusion Electrodes Loaded with Inorganic Catalyst"; Nagakazu Furuya and Hiroshi Yoshiba; J. Electroanal. Chem., 291 (1990), pp. 269-272.

"Electrochemical Behavior of Nitride Ions in a Molten Chloride System"; Takuka Goto, Masayuki Tada, and Yasuhiko Ito, Eletrochemical Society, vol. 144, No. 7, Jul. 1997, pp. 2271-2275.

"Acceleration of Electrochemical Titanium Nitride Growth by Addition of LiH in a Molten LiCl-KCl-$Li_3N$ System", T.Nishiklor, T. Nohira, T. Goto, and Y. Ito, Electrochemical and Solid-State Letters, 2 (6) 278-280 (1999).

"Molten Salts—a survey of recent developments", J H R Clarke and G J Hills, Reprinted from chemistry in Britain, vol. 9, No. 1, Jan. 1973, Current awareness.

"Surface Electrochemistry of the Anodic $N_2$ Generation Reaction at Pt and Au, and the Discovery of Cathodic $N_2$ Evolution", S. G. Roscoe and B. E. Conway, J. Electroanal Chem. 249 (1988) 217-239.

"Efficient Electrochemical Reduction of N2 to NH3 Catalyzed by Lithium"; Akira Tsuneto, Akihiko Kudo and Tadayoshi Sakata; Chemistry Letters, pp. 851-854, 1993.

International Search Report 4 pgs; International Application No. PCT/US 03/06407; International filing Date Apr. 3, 2003.

"Electrolytic Synthesis of Ammonia in Molten Salts under Atmospheric Pressure"; Tsuyoshi Murakami, Tokujiro Nishiklori, Toshyuki Nohira, and Yashuhiko Ito; J. Am. Chem. Soc. 2003, 125, pp. 334-335; XP002289405.

"An Innovative H2/O2 Fuel Cell Using Molten Hydride Electrolyte[1]—A Molten Hydride Electrolyte Fuel Cell" (MHFC)™; Prodyot Roy, Jan. 2003, 4 pgs.

"Electrochemical reduction of nitrogen gas in a molten chloride system"; Takuya Goto and Yashuhiko Ito; Electrochemica Acta, vol. 43, Nos. 21-22, pp. 3379-3384, 1998.

"Electroreduction of Nitrogen to Ammonia on Gas-Diffusion Electrodes Modified by Metal Phtalocyanines"; Nagakazu Furuya and Hiroshi Yoshiba; J. Electroanal. Chem., 272 (1989) 263-266.

"Electroreduction of Nitrogen to Ammonia on Gas-Diffusion Electrodes Modified by Fe-phtalocyanine"; Nagakazu Furuya and Hiroshi Yoshiba; J. Electroanan. Chem., 263 (1989); pp. 171-174.

"Dinitrogen Electrochemical Reduction to Ammonia Over Iron Cathode in Aqueous Medium"; A. Sclafani, V. Augugliaro and M. Schiavello; J. Electrochem. Soc.: Accelerated Brief Communication; Mar. 1983; pp. 734-736.

"Electrochemical Synthesis of Ammonia at Atmospheric Pressure and Low Temperature in a Solid Polymer Electrolyte Cell"; V. Kordali, G. Kyriacou and Ch. Lambrou; Chem. Commun., 2000, pp. 1673-1674.

* cited by examiner

ELECTROCHEMICAL SYNTHESIS OF AMMONIA

This application claims priority from U.S. provisional patent application 60/607,653, filed on Sep. 7, 2004.

BACKGROUND OF THE INVENTION

1. Field of the Invention

This invention relates to an electrochemical method and apparatus for the synthesis of ammonia. In particular, the invention relates to an anodic electrochemical method and apparatus for the electrosynthesis of ammonia.

2. Background to the Related Art

Ammonia ($NH_3$) is a colorless alkaline gas that is lighter than air and possesses a unique, penetrating odor. Since nitrogen is an essential element to plant growth, the value of nitrogen compounds as an ingredient of mineral fertilizers, was recognized as early as 1840. Until the early 1900's, the nitrogen source in farm soils was entirely derived from natural sources. Haber and Bosch pioneered the synthesis of ammonia directly from hydrogen gas and nitrogen gas on a commercial scale in 1913. Further developments in large-scale ammonia production for fertilizers have made a significant impact on increasing the world's food supply.

Virtually every nitrogen atom of a nitrogen compound travels from the atmosphere to its destined chemical combination by way of ammonia. Industrial uses of ammonia as a nitrogen source have recently consumed a greater share of the total ammonia production, accounting for 20% of the world output. Up to 80% of the ammonia produced is used for the production of nitrogen-based fertilizers, accounting for about 3% of the world's energy consumption. In many developing countries, the capability for ammonia synthesis is the first sign of budding industrialization. In the United States last year there was over 19 billion tons of ammonia produced.

Many methods of ammonia synthesis have been investigated. These methods include the catalytic synthesis of ammonia from its elements using high pressures and high temperatures, indirect ammonia synthesis using steam initiated decomposition of nitrogen based compounds, and the formation of ammonia with the aid of an electrical discharge.

The gas-phase catalytic synthesis of ammonia from its constituent elements, nitrogen gas and hydrogen gas, utilizing an iron-based catalyst at high pressures and high temperatures, is the standard industrial process by which ammonia is produced on an industrial scale worldwide.

$$N_{2(g)} + 3H_{2(g)} \xrightleftharpoons[15-30MPa;430-480°C]{Iron-based\ catalyst} 2NH_{3(g)}\quad H_{298} = -45.72\ \text{kJ/mol} \tag{1}$$

Since during this gas-phase reaction there is a significant decrease in gas volume as ammonia product is formed, very high pressures must be used to drive the ammonia synthesis reaction to the right of Equation 1, that is in the direction of formation of ammonia gas. The gas-phase synthesis process is an equilibrium process. Thus, carrying out ammonia synthesis at very high pressures is also necessary to prevent back decomposition of synthesized ammonia at the temperatures required to activate the forward reaction process and to provide practical reaction rates. Even then, the equilibrium conversion of hydrogen gas and nitrogen gas to ammonia gas is only on the order of 10 to 15%. Low conversion efficiencies give rise to cost intensive, large scale chemical plants and to costly operating conditions (compression of reactant gases) in order to produce commercially viable hundreds-to-thousands of tons-per-day of ammonia in an ammonia synthesis plant.

Only recently has the feasibility of using electrochemical processes for ammonia synthesis been demonstrated. Except for one, all of the electrochemical processes for the synthesis of ammonia reported to date have involved the cathodic reduction of nitrogen gas at the cathode of an electrochemical cell. Both aqueous-based and organic solvent-based electrolyte solutions have been used at ambient temperature and atmospheric pressure. In these liquid electrolyte solution-based investigations the source of hydrogen (usually in the form of protons) required for the formation of ammonia is provided by the electrochemical decomposition of water or an organic solvent, such as ethanol, at the anodes of the electrochemical cells.

Tsuneto et al., Chemistry Letters, pp. 851-854, 1993, disclosed the use of an ambient temperature electrochemical process utilizing an organic solvent-based electrolyte solution that contained lithium perchlorate as the electrolyte where ammonia gas was formed with a current efficiency of 8% on flowing nitrogen gas at atmospheric pressure over either a titanium metal or silver metal cathode. On using a copper metal cathode and an electrochemical cell temperature of 50° C., a current efficiency of 48% for the production of ammonia was obtained on flowing nitrogen gas at a pressure of 50 atmospheres over the cathode.

Recently, Marnellos and Stoukides published an article entitled "Ammonia Synthesis at Atmospheric Pressure," Science, vol. 282, Oct. 2, 1998, that disclosed a cathodic electrochemical process for the synthesis of ammonia that avoids the use of aqueous-based or organic solvent-based electrolyte solutions. With this process, electrosynthesis of ammonia takes place at the surface of a porous metal cathode attached to one side of a strontia-ceria-ytterbia (SCY) peroskite solid state proton ($H^+$) conductor. The electrochemical process is operated at atmospheric pressure and 570° C., which is a similar temperature to that used in the Haber-Bosch catalytic process. The apparatus consists of a non-porous, strontia-ceria-ytterbia (SCY) perovskite ceramic tube closed at one end and then further enclosed in a quartz ceramic tube. Electrodes, made from porous polycrystalline palladium films, are deposited on the inner and outer walls of the SCY tube.

Initially, ammonia gas is passed through the system, where the amount of thermal decomposition due to the high operating temperature (570° C.) can be measured. Subsequently, gaseous hydrogen is passed through the quartz tube and over the anode surface, where the hydrogen is converted to protons:

$$3H_2 \rightarrow 6H^+ + 6e^- \tag{2}$$

The protons are then transported through the proton conducting solid perovskite electrolyte to the cathode surface, on applying an electrical potential between the cathode and the anode, where they come in contact with the nitrogen gas and the following reaction takes place:

$$N_2 + 6H^+ + 6e^- \rightarrow 2NH_3 \tag{3}$$

Operating at a cell temperature of 570° C. and at atmospheric pressure, greater than 78% of the electrochemically supplied hydrogen from the anode which was transported through the solid electrolyte to the cathode was converted into ammonia. However, the process is limited by slow electrochemical reaction rates due to low proton ($H^+$) fluxes through the solid electrolyte at 570° C. Increasing the temperature to obtain higher proton ($H^+$) fluxes would also increase the rate of thermal decomposition of ammonia.

A major drawback of both low (and high) temperature cathodic electrochemical processes is that the competing hydrogen gas evolution reaction takes place more readily than the formation of ammonia since recombination of adsorbed hydrogen atoms with each other is more likely to occur than reaction between adsorbed hydrogen atoms and adsorbed nitrogen molecules due to the high bond strength (~1000 kJ $mol^{-1}$ at 25° C.) of the N≡N triple bond of a nitrogen molecule.

More recently an anodic electrochemical process for the synthesis of ammonia was disclosed in U.S. Pat. No. 6,712,950 which is commonly owned by the assignee of the present application. This new anodic electrochemical process overcomes many of the limitations of the earlier discussed cathodic electrochemical processes. The anodic process uses molten salts selected from those having melting points that range from room temperature to greater than 400° C. and containing a dissolved nitride ion-containing salt, such as lithium nitride ($Li_3N$), as the electrolyte. The anode is comprised of either a porous structure or a membrane permeable to hydrogen gas. Hydrogen is introduced into the electrochemical cell at the anode/molten salt electrolyte interface. The cathode is also comprised of a porous structure and nitrogen gas is introduced into the electrochemical cell at the cathode/molten salt electrolyte interface.

On allowing current to flow through the electrochemical cell, a nitrogen gas molecule is reduced to nitride ions ($N^{3-}$) at the cathode/molten salt electrolyte interface, as represented by Equation 4:

$$N_2+6e^-\rightarrow 2N^{3-} \quad (4)$$

Due to the applied electrical potential between the cathode and the anode, nitride ions ($N^{3-}$) migrate from the cathode/molten salt electrolyte interface to the anode/molten salt electrolyte interface. At the anode/molten salt electrolyte interface, nitride ions ($N^{3-}$) are oxidized to produce adsorbed nitrogen atoms, as represented by Equation 5:

$$2N^{3-}\rightarrow 2N_{ads}+6e^- \quad (5)$$

Adsorbed nitrogen atoms react with either adsorbed hydrogen molecules, or more likely with adsorbed hydrogen atoms, on the surface of the anode to produce ammonia gas molecules as represented by Equation 6:

$$2N_{ads}+6H_{ads}\rightarrow 2NH_3 \quad (6)$$

With this process a current efficiency of over 50% was obtained for the production of ammonia.

The formation of nitride ions ($N^{3-}$) at the cathode by the electrochemical reduction of nitrogen gas molecules and their conversion at the anode to give adsorbed nitrogen atoms by electrochemical oxidation of nitride ions ($N^{3-}$) forms the basis of the anodic process for the production of ammonia. In this anodic process, the nitride anion ($N^{3-}$) is the only electrochemically active anionic species present in the molten salt that participates in the formation of ammonia gas. Hydrogen gas molecules, or more preferably adsorbed hydrogen atoms, participate in a subsequent chemical step and it is believed that the current efficiency for the formation of ammonia is controlled by the successful reaction between adsorbed nitrogen atoms and adsorbed hydrogen atoms on the surface of the anode. Sufficient coverage of the anode surface with adsorbed hydrogen atoms is dependent on the dissociative adsorption of hydrogen gas molecules under the operating conditions of temperature and pressure in a molten salt environment and also by the affinity of the surface of the anode electrocatalyst for adsorbed hydrogen species.

Therefore, there remains a need for an improved method of producing ammonia.

It would be desirable if the improved anodic method could produce ammonia at lower temperatures and lower pressures, while achieving a greater conversion than existing methods. It would be even further desirable if the improved anodic electrochemical method were compatible with existing process units, such as being able to use the same hydrogen and nitrogen sources as are used in the Haber-Bosch process.

SUMMARY OF THE INVENTION

The present invention provides methods and apparatus for electrochemically synthesizing ammonia gas from negatively charged nitrogen-containing species and negatively charged hydrogen-containing species in an electrolyte. The negatively charged nitrogen-containing species may be provided by a nitrogen-containing salt component in the electrolyte, a nitrogen-containing gas supplied to the cathode, or a combination thereof. Similarly, the negatively charged hydrogen-containing species may be provided by a hydrogen-containing salt component in the electrolyte, a hydrogen-containing gas supplied to the cathode, or a combination thereof. Accordingly, there are various combinations of sources for the negatively charged species, including any one or more of the sources of negatively charged nitrogen-containing species in combination with any one or more of the sources of negatively charged hydrogen-containing species.

In one embodiment, the method comprises the steps of providing an electrolyte between an anode and a cathode, providing nitrogen gas ($N_2$) and hydrogen gas ($H_2$) to the cathode, oxidizing negatively charged nitrogen-containing species and negatively charged hydrogen-containing species present in the electrolyte at the anode to form adsorbed nitrogen species and adsorbed hydrogen species, respectively, and reacting the adsorbed nitrogen species with the adsorbed hydrogen species to form ammonia. The negatively charged nitrogen-containing species is preferably a nitride ion ($N^{3-}$), such as obtained from dissolved lithium nitride, or an azide ion ($N^{3-}$), such as obtained from dissolved sodium azide. The negatively charged hydrogen-containing species is preferably a hydride ion ($H^-$), such as obtained from dissolved lithium hydride, or a borohydride ion ($BH_4^-$), such as obtained from dissolved sodium borohydride.

The reaction is preferably carried out at a temperature between 0 and 1000° C., such as a temperature between 25 and 800° C. or between 100 and 700° C., or more preferably between 300 and 600° C., although a lower temperature of between 25 and 150° C. may be desirable. The method includes applying a voltage between the anode and the cathode, where the voltage is preferably up to 2 Volts, up to 1 Volt, or up to 0.5 Volt. It is also preferred to apply a current density between the anode and the cathode of up to 2 A/$cm^2$, up to 1 A/$cm^2$, up to 0.3 A/$cm^2$, or up to 0.1 A/$cm^2$. Furthermore, the reaction is typically carried out at a pressure between 1 and 250 atmospheres, preferably between 1 and 100 atmospheres, more preferably between 1 and 50 atmospheres, even more preferably between 1 and 20 atmospheres, and most preferably up to 5 atmospheres, including atmospheric pressure.

The hydrogen gas and nitrogen gas preferably have a purity of greater than 70%, more preferably greater than 90%, and most preferably greater than 99%. The hydrogen gas and nitrogen gas are preferably provided to the cathode by passing the hydrogen gas and nitrogen gas through a porous cathode substrate. Preferably, the hydrogen gas and nitrogen gas pass from a first face of the porous cathode substrate to a parallel opposite face of the porous cathode substrate, wherein the parallel opposite face is in contact with the electrolyte. The mole ratio of hydrogen gas to nitrogen gas supplied to the porous cathode substrate is preferably in the range 0.15 to 3.00, more preferably in the range of 0.3 to 2.0, and even more preferably in the range of 0.6 to 1.5.

The porous anode substrate is preferably made from a carbonaceous material such as graphite, a metal, metal alloy, an electronically conducting ceramic, or a combination thereof, most preferably made from nickel, a nickel containing compound, or a nickel alloy, such as Hasteloy, Inconel and Monel. Alternatively, the porous anode substrate may be selected from metal carbides, metal borides, and metal nitrides. The porous anode substrate preferably has porosity greater than 40% void volume, but may have porosity greater than 90%. A porous anode substrate preferably has a pore size of about 0.02 to 20 microns, most preferably from 0.05 to 1 micron. In addition, it is optional to provide a catalyst disposed on the surface of the anode substrate, preferably wherein the catalyst is disposed on at least part of the surface of the porous anode substrate facing the electrolyte. The anode catalyst, preferably in a high surface area form, is selected from iron, ruthenium, titanium, palladium, binary metal alloys including at least one of these elements, and ternary metal alloys including at least one of these elements.

It is preferred to produce the negatively charged nitrogen-containing species in the electrolyte by reducing nitrogen gas at the cathode. It also is preferred to produce the negatively charged hydrogen-containing species in the electrolyte by reducing hydrogen gas at the cathode. The hydrogen gas may be delivered to the cathode from a process selected from steam reformation, partial oxidation, autothermal reformation, and plasma reformation of hydrocarbons, such as natural gas, propane, diesel, naphtha, and coal. Alternatively, hydrogen gas may be provided to the porous cathode substrate by electrolyzing water. In any of these embodiments, the hydrogen gas may be delivered to the porous cathode substrate along with a carrier gas. The nitrogen gas and hydrogen gas may be delivered separately, or as a gas mixture, through a porous cathode substrate.

The porous cathode substrate is preferably made from a carbonaceous material such as graphite, a metal, metal alloy, ceramic or a combination thereof, most preferably made from nickel, a nickel-containing compound, or a nickel alloy, such as Hasteloy, Inconel, and Monel. Alternatively, the porous cathode substrate may be selected from metal carbides, metal borides and metal nitrides. The porous cathode substrate has porosity greater than 40% void volume, but may have porosity greater than 90%. A porous cathode substrate preferably has a pore size of about 0.02 to 20 microns, most preferably from 0.05 to 1 micron. The porous cathode substrate may be coated with a porous electrocatalyst, for example an electrocatalyst selected from transition metals, noble metals, and combinations thereof.

The nitrogen gas and hydrogen gas preferably contain less than 1000 ppm moisture, more preferably less than 100 ppm moisture, and most preferably less than 10 ppm moisture. The moisture may be controlled or reduced by passing the nitrogen gas and the hydrogen gas through a water sorbent material before delivery to the porous cathode. The nitrogen gas and the hydrogen gas should also contain less than 0.1% oxygen, preferably less than 0.01% oxygen, and most preferably less than 0.001% oxygen. Preferably the process includes providing hydrogen gas and nitrogen gas to the cathode/electrolyte interface to produce negatively charged hydrogen-containing species and negatively-charged nitrogen-containing species, respectively, in the electrolyte, wherein the hydrogen gas and the nitrogen gas are provided at gas pressures greater than the pressure of the reaction.

The electrolyte preferably comprises a molten salt electrolyte that supports migration of the negatively charged nitrogen-containing species and negatively-charged hydrogen-containing species between the cathode and the anode. Molten salt electrolytes can be selected from alkali metal halides, such as alkali metal chlorides, alkali metal bromides, and alkali metal iodides. A preferred molten salt electrolyte comprises lithium bromide, potassium bromide and cesium bromide, most preferably wherein the molten salt has a greater molar concentration of lithium bromide than potassium bromide and cesium bromide combined. An equally preferred molten salt is selected from ionic liquids based on alkylammonium, alkylphosphonium, N-alkylpyridinium, N-alkylimidazolium (or N, N'-dialkylimidazolium) cations and their derivatives with various anions, such as halides, hexafluorophosphate, tosylate, and tetrafluoroborate.

Preferably, the molten salt electrolyte is charged with a nitride compound, an azide compound, or a combination thereof. The preferred nitride compounds are the alkali metal nitride salts, such as lithium nitride. Most preferably, the molten salt electrolyte also is charged with a hydride compound, a borohydride compound, or a combination thereof. The preferred hydride compounds are the alkali metal hydride salts, such as lithium hydride, and the preferred borohydride compounds are the alkali metal borohydrides, such as sodium borohydride. Furthermore, the molten salt may further comprise one or more metal salts selected from chlorides, iodides, bromides, sulfides, phosphates, carbonates, and mixtures thereof. Where the metal salt comprises metal halides, such as, metal chlorides, the metal chloride may comprise rubidium chloride, cesium chloride, ruthenium chloride, iron chloride, or a mixture thereof.

The electrolyte may optionally comprise one or more salts dissolved in an organic solvent similar to those used in lithium metal or lithium-ion batteries. The method should include maintaining an inert atmosphere over the electrolyte. Suitable salts would include lithium hexafluorosphosphate ($LiPF_6$) or lithium perchlorate ($LiClO_4$) and suitable organic solvents would include propylene carbonate, ethylene carbonate, dimethyl carbonate, or blends of these solvents. The electrolyte solution comprising a salt dissolved in a solvent may be held within a polymer matrix, such as porous polypropylene, or porous polyethylene, or present as a gel produced by swelling either polyacrylonitrile, polyvinylidene fluoride or polyethylene oxide with the solvent.

Optionally, the electrolyte may be disposed within a porous matrix. For example, a porous matrix may be a tile fabricated by hot-pressing alkali metal chlorides, alkali metal bromides, or alkali metal iodides and lithium aluminate ($LiAlO_2$) or tape-casting lithium aluminate ($LiAlO_2$) matrices, either in the presence or absence of powdered metal halides. Tape casting can continuously manufacture matrices as thin as 0.03 to 0.07 centimeters and 45-55% porous with a mean pore size of 0.5 micrometers.

The present invention also provides an apparatus comprising a porous anode substrate in fluid communication with an exit port for the gaseous product (ammonia), a porous cathode substrate in fluid communication with a source of gaseous reactants, such as, nitrogen gas and hydrogen gas, and an electrolyte disposed within a matrix, wherein the matrix is disposed between the porous anode substrate and the porous cathode substrate. Optionally, a catalyst may be disposed on the porous anode substrate and/or the porous cathode substrate facing the electrolyte matrix. Preferably the catalyst on the porous anode substrate is an ammonia generating catalyst disposed at least on the surface of the porous anode facing the electrolyte. The preferred catalysts capable of generating ammonia comprise a metal selected from iron, ruthenium and combinations thereof. In particular, the catalyst may be a ruthenium catalyst that is activated by cesium, or cesium and barium. The activated catalysts may be supported on a catalyst support, such as high surface area carbon or graphite.

Furthermore, the present invention provides an apparatus comprising a plurality of electrolytic cells and a bipolar plate separating each of the plurality of electrolytic cells. Accordingly, each of the plurality of electrolytic cells comprises a porous anode substrate in fluid communication with an exit port for the gaseous product (ammonia), a porous cathode substrate in fluid communication with a source of gaseous reactants, such as nitrogen gas and hydrogen gas, an electrolyte disposed within a matrix placed between the porous anode substrate and the porous cathode substrate, an anodic fluid flow field in electronic communication with the porous anode substrate opposite the matrix, and a cathodic fluid flow field in electronic communication with the porous cathode substrate opposite the matrix. Preferably, the anodic fluid flow field has a first face that is in electronic communication with the porous anode substrate and a second face in electronic communication with a first bipolar plate, and the cathodic fluid flow field has a first face that is in electronic communication with the porous cathode substrate and a second face in electronic communication with a second bipolar plate.

Optionally, a gas diffusion layer may be disposed between the anodic fluid flow field and the porous anode substrate. Alternatively, a catalyzed gas diffusion layer or a catalyzed electrode backing layer may be disposed between the anodic fluid flow field and a first side of the electrolyte matrix. Similarly, a gas diffusion layer may be disposed between the cathodic fluid flow field and the porous cathode substrate. Alternatively, a catalyzed gas diffusion layer or a catalyzed electrode backing layer may be disposed between the cathode fluid flow field and a second side of the electrolyte matrix.

The apparatus will typically further comprise mixed gas (comprising hydrogen and nitrogen) inlet and outlet manifolds for providing the fluid communication between the source of gaseous reactants (hydrogen gas and nitrogen gas) and each of the porous cathode substrates, and an ammonia product gas outlet manifold for providing fluid communication between an ammonia exit port attached to the apparatus and each of the porous anode substrates. The gaseous reactants and gaseous product manifolds are selected from either an internal manifold arrangement or an external manifold arrangement. In a preferred embodiment, anodic cell frames and cathodic cell frames are disposed around the anode flow fields and porous anode substrates (and any gas diffusion layers or electrode backing layers if included) and cathode flow fields and porous cathode substrates (and any gas diffusion layers or electrode backing layers if included), respectively. These cell frames must be able to withstand the high temperatures, high pressures and harsh chemical environment of the molten salts. Accordingly, the cell frames may be made, for example, from polyimide polymers, Macor® (a machineable glass ceramic), mica, graphite, nickel, stainless steel, Inconel or Monel. It will be apparent to one skilled in the art of electolyzers that seals comprising gaskets and/or o-rings will be suitably used between certain components within an electrolytic cell and between electrolytic cells to prevent leaks. Gaskets, and o-rings may be made, for example, from Viton®, Kalrez®, silicone polymers, polyimide polymers, Macor®, mica, or graphite.

In one embodiment, the porous anode substrate and the porous cathode substrate are each selected from metal foams, metal grids, sintered metal particles, sintered metal fibers, woven and nonwoven metal cloths, perforated or etched metal sheets, porous graphite, graphite or carbon-based foams, cloths, or aerogels, and combinations thereof. Preferably, two or more of the metal components of an electrolytic cell are metallurgically bonded together, such as by a process selected from welding, brazing, soldering, sintering, fusion bonding, vacuum bonding, and combinations thereof. For example, the anodic fluid flow field may be metallurgically bonded to the bipolar plate, the cathodic fluid flow field may be metallurgically bonded to the bipolar plate, the anodic fluid flow field may be metallurgically bonded to the porous anode substrate, the cathodic fluid flow field may be metallurgically bonded to the porous cathode substrate, and combinations thereof.

BRIEF DESCRIPTION OF THE DRAWINGS

So that the above recited features and advantages of the present invention can be understood in detail, a more particular description of the invention, briefly summarized above, is provided in reference to the embodiments thereof, which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
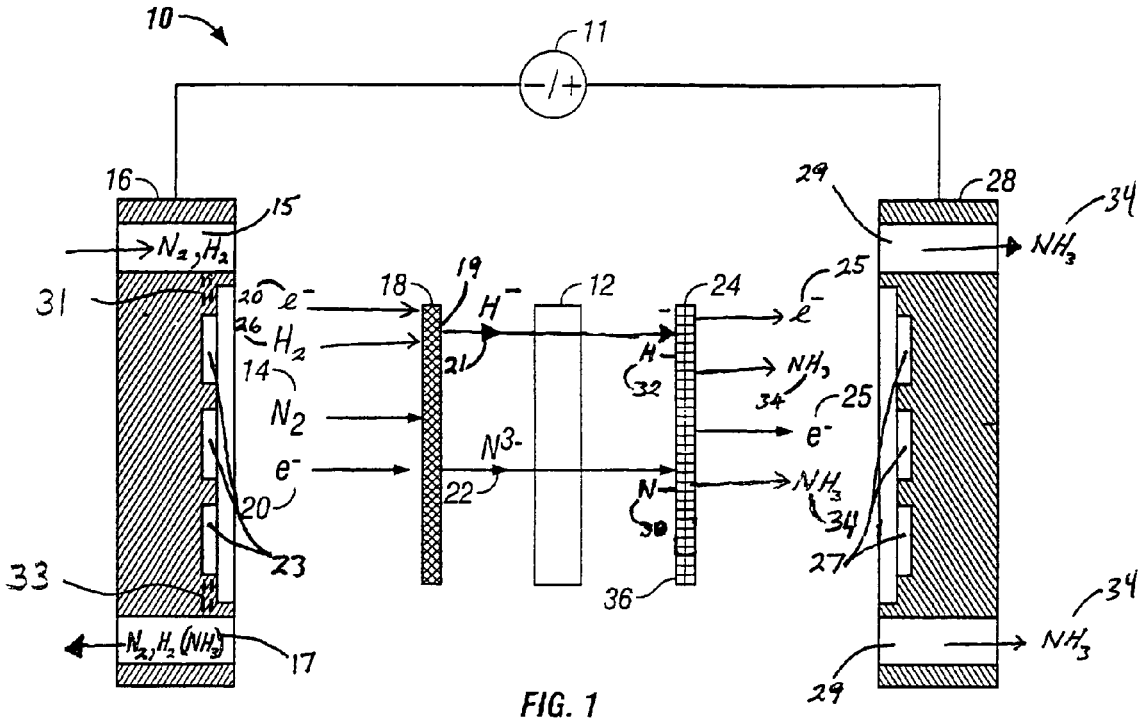
FIG. 1 is an expanded schematic flow diagram of an ammonia electrosynthesis cell having endplates with flow channels.

The present invention provides a method for the electrochemical synthesis of ammonia gas. More specifically, the present invention provides a method for the anodic electrochemical synthesis of ammonia gas from its constituent elements, nitrogen gas and hydrogen gas. The method comprises providing an electrolyte between an anode and a cathode, providing nitrogen gas and hydrogen gas to the cathode, oxidizing negatively charged nitrogen-containing species and negatively charged hydrogen-containing species present in the electrolyte at the anode to form adsorbed nitrogen species and adsorbed hydrogen species, respectively, and reacting the adsorbed nitrogen species with the adsorbed hydrogen species to form ammonia. Preferably, the nitrogen gas and the hydrogen gas are provided to the cathode by passing the nitrogen gas and the hydrogen gas through a porous cathode substrate. It is also preferred to produce the negatively charged nitrogen-containing species and the negatively charged hydrogen-containing species in the electrolyte by reducing nitrogen gas and hydrogen gas, respectively, at the cathode/electrolyte interface. However, the negatively charged nitrogen-containing species may also be provided by supplying a nitrogen-containing salt, such as lithium nitride, into the molten salt electrolyte mixture in a sufficient amount to provide some or all of the nitrogen consumed in the production of ammonia. Similarly, the negatively charged hydrogen-containing species may also be provided by supplying a hydrogen-containing salt, such as lithium hydride, into the molten salt electrolyte in a sufficient amount to provide some or all of the hydrogen consumed in the production of ammonia.

The present invention also provides an apparatus for generating ammonia gas. The apparatus comprises a porous anode substrate in fluid communication with an exit port for the gaseous ammonia product, a porous cathode substrate in fluid communication with a source of hydrogen gas and a source of nitrogen gas, and an electrolyte disposed between the porous anode substrate and the porous cathode substrate, where the electrolyte is preferably a molten salt disposed within a matrix. The anode substrate and/or the cathode substrate may have a catalyst disposed on the surface of the substrate facing the electrolyte. The apparatus may include a stack of electrochemical cells, including a bipolar separator plate disposed between each of the cells in the stack. The apparatus is compatible with either internal manifolding or external manifolding for the supply of the reactant gases (hydrogen and nitrogen gases) to the cathode of each individual cell, as well as the removal of the product gas (ammonia gas) from the anode of each individual cell. In a particularly preferred embodiment, two or more adjacent metallic components of a cell are metallurgically bonded to form an integrated subassembly in order to reduce the electrical resistance of the cell and reduce the number of separate components that must be assembled.

FIG. 1 is an expanded schematic flow diagram of an ammonia electrosynthesis cell in accordance with one embodiment of the present invention. The electrochemical cell or reactor 10 is provided with a molten salt electrolyte where the molten salt electrolyte is contained within a chemically and thermally stable, electronically non-conducting porous matrix material 12. The porous matrix material must be wet by the molten salt electrolyte and must be sufficiently microporous to retain the molten salt thickness of the matrix due to capillary forces and be capable of withstanding bubble pressures of up to 2 psi, preferably up to 4 psi, more preferably up to 8 psi, and most preferably up to 16 psi. A suitable microporous matrix material may be selected from lithium aluminate ($LiAlO_2$) sheets, borosilicate glass fiber filters, woven mats of yttria-stabilized zirconia, Fiberfax® Lo-Con™ felts and Duraset® felts, zirconia felts and cloths, alumina felts and cloths, yttria felts and cloths, and Fiberfrax® Duraboard® ceramic fiber boards. The cell is heated to keep the electrolyte in a molten state and may be pressurized. Flowing nitrogen gas ($N_2$) 14 and hydrogen gas ($H_2$) 26 are introduced into the cell 10 from a manifold 15 in an endplate 16 via flow channels 23 and through a porous cathode substrate 18. The flow channels 23 are in fluid communication with the manifold 15 through channels 31 and in fluid communication with the face of the porous cathode substrate 18. Optionally, the nitrogen gas and the hydrogen gas are heated to the operating temperature of the electrochemical cell before being introduced into the cell. The molecular nitrogen gas 14 and molecular hydrogen gas 26 are reduced by electrons 20 to give two nitride ions ($N^{3-}$) 22 and two hydride ions ($H^-$) 21, respectively, at the cathode/molten salt electrolyte interface 19 in a six-electron reduction process and a two electron reduction process, respectively. The nitride ions 22 and the hydride ions 21, which are stable in the molten salt electrolyte, migrate through the electrolyte/matrix combination 12 towards the anode 24.

Unreacted nitrogen gas ($N_2$) 14 and hydrogen gas ($H_2$) 26 are removed from the cell 10 through a manifold 17 in the endplate 16 via flow channels 23 and the porous cathode substrate 18. The flow channels 23 are in fluid communication with the manifold 17 though channels 33 and in fluid communication with the face of the porous cathode substrate 18. Any ammonia formed at the cathode due to reaction between adsorbed hydrogen species and adsorbed nitrogen species on the surface of the cathode can also be removed from the cell with the flowing nitrogen gas and hydrogen gas. Any ammonia in the flowing gas stream can be condensed out and recovered. Unreacted nitrogen gas and hydrogen gas can be returned to the cell 10 along with makeup nitrogen gas and hydrogen gas.

The cathode 18 is a porous, electronically conducting member where nitrogen or nitrogen-containing compounds and hydrogen or hydrogen-containing compounds are reduced to a negatively charged nitrogen species and a negatively charged hydrogen species, respectively. The cathode may be made from a metal, metal alloy or ceramic material. Preferably, the cathode is made from porous nickel or a nickel-containing compound, such as a nickel alloy (Hasteloy, Inconel, Monel, Stainless steel and their families of alloys).

The anode 24 is a porous, electronically conducting member allowing the removal of the product ammonia gas 34 via flow channels 27 in fluid communication with manifold 29 from endplate 28. The nitride ions 22 and the hydride ions 21 reach the porous anode 24 where the electron transfer oxidation reactions occur and the nitride ions and the hydride ions are oxidized to adsorbed atomic nitrogen (N) 30 and adsorbed atomic hydrogen (H) 32, respectively, by giving up electrons 25. The oxidation potential for the nitride ion to atomic nitrogen occurs at a slightly more negative potential than the oxidation potential for hydride ion to atomic hydrogen and thus it will occur in preference to the hydrogen reaction. The atomic nitrogen 30 adsorbed on the anode surface 36 at the anode/molten salt electrolyte interface then reacts with neighboring adsorbed hydrogen atoms 32 to produce ammonia gas 34 that is evolved and collected. Preferably, the porous anode substrate 24 includes a catalyst-coating, such as iron, ruthenium, or a mixture thereof disposed on the surface 36 facing the electrolyte.

The kinetics of the ammonia production reaction can be controlled by regulating the electrode potentials, or more practically the cell potential. For example, by controlling the cathode potential, the current efficiency for the conversion of nitrogen gas to nitride ion in a molten salt electrolyte with a nickel cathode is greater than 93%. The conversion of nitrogen gas and hydrogen gas to ammonia gas is an exothermic reaction and hence the conversion increases with decreasing temperature. The present method for anodic electrochemical generation of ammonia will operate at considerably lower temperatures than those used in the Haber-Bosch process, thereby benefiting the equilibrium process represented by Equation (1). It is believed that by combining galvanostatic control, or preferably potentiostatic control, low operating temperatures, and pressure regulation, the present anodic electrochemical method will produce ammonia in higher yields than that produced by current methods.

Nitrogen gas is the preferred source of the negatively charged nitrogen-containing species. Hydrogen gas is the preferred source of the negatively charged hydrogen-containing species. Preferably, both the nitrogen gas and hydrogen gas used for the electrolysis are of high purity and preferably contain less than 10 ppm moisture and 10 ppm oxygen. This can be achieved by using a high-purity nitrogen source and a high purity hydrogen source where each gas is passed though a water adsorbent material before it enters the reactor. The nitrogen gas may be supplied from the same nitrogen gas source currently used in catalytic ammonia manufacturing. Alternatively, the nitrogen gas can be provided by a liquid nitrogen source, a pressure swing adsorption apparatus that separates nitrogen gas from the air, or the decomposition of nitrogen containing compounds. Nitrogen gas can also be introduced to the cell in combination with a carrier gas such as argon, or other inert gaseous materials, such as helium, or a combination thereof. Preferably, the nitrogen is introduced to the system via a series of flow fields or flow field/gas diffusion electrode or backing electrode arrangements. The flow of the nitrogen gas can be controlled via a series of pumps, valves, pressurized vessels, suction devices or a combination thereof.

The hydrogen gas may be obtained from the same sources as it is presently obtained for use in conventional catalytic processes for ammonia production, including coke oven gas and coal, natural gas, naptha, and other petroleum products converted via steam reformation, autothermal reformation, plasma reformation, or partial oxidation. Alternatively, the hydrogen gas can be supplied by the electrolysis of water or the decomposition of other hydrogen-containing compounds including metal hydrides. The hydrogen can also be introduced to the cell along with a carrier gas, such as argon or other inert gaseous materials, such as helium, or a combination thereof. Preferably, the hydrogen gas is introduced to the system via a series of flow fields or flow field/gas diffusion electrode or backing electrode arrangements. The flow of the hydrogen gas can be controlled via a series of pumps, valves, pressurized vessels, suction devices or a combination thereof.

The electrolyte must include a component that is capable of forming, stabilizing and permitting migration of the negatively charged nitrogen-containing species and the negatively charged hydrogen-containing species between the cathode and anode. Also, this component of the electrolyte must be chemically, thermally, and electrochemically stable and inert under the conditions required for the anodic electrochemical synthesis of ammonia. The anion of the molten salt (chloride, bromide, or iodide for example) must not undergo an electrochemical oxidation process at the anode and the cation of the molten salt (lithium, sodium, potassium, or cesium for example) must not undergo an electrochemical reduction process at the cathode. The preferred electrolyte comprises one or more molten salts selected from metal chlorides, metal iodides, metal bromides, metal carbonates, metal sulfides, metal phosphates, and mixtures thereof. It is also preferred to add other salts, such as rubidium chloride, cesium chloride, ruthenium chloride, iron chloride, or a mixture thereof, in small portions, such as 0.1 to 5 mole percent, to lower the melting temperature of the eutectic. Preferred molten salt mixtures include 56.1 mol % LiBr/18.9 mol % KBr/25.0 mol % CsBr (eutectic melt, melting point 225° C.); 58.8 mol % LiCl/41.2 mol % KCl (eutectic melt, melting point 352° C.); and 57.5 mol % LiCl/13.3 mol % KCl/29.2 mol % CsCl (eutectic melt, melting point 265° C.). However, in addition to the foregoing electrolytes, it is believed that the present invention will also operate using low temperature molten salts, described in more detail below.

The electrolyte will preferably also contain an electroactive species or component, such as nitride ions (or azide ions) and hydride ions (or borohydride ions), that are present not as a result of a reduction or oxidation reaction of a nitrogen-containing species or a hydrogen-containing species, respectively, at the electrodes, but are present as species that have been added to the electrolyte. For example, it is preferred to provide the electrolyte with small quantities of $Li_3N$ in the range of concentrations of 0.1 to 5.0 mol % and with small quantities of LiH in the range of concentrations of 0.1 to 5.0 mol % to allow the ammonia production reaction to start. Finally, it is preferred to charge the electrochemical cell with the mixed, dried electrolyte salts and heat them into a molten state, but it is also possible to melt the electrolyte before charging the electrolyte into the cell. Prior to melting, the salts should be dried and mixed together in an inert atmosphere, preferably with less than 10 ppm moisture.

The chemical hydrides of some of the lighter metallic elements have been considered as a source of hydride ion for the anodic electrochemical synthesis of ammonia because they possess high concentrations of hydrogen atoms that can be released by anodic oxidation. Table 1 lists a number of the chemical hydrides of elements from the first and second groups of the periodic table that are useful for hydride ion generation, although the list is not meant to be exhaustive of all chemical hydrides suitable for use in an electrochemical reactor for the production of ammonia. The hydrides in Table 1 are divided into groups of salt-like hydrides and covalent hydrides. Table 1 provides the hydrogen content of each of the compounds.

TABLE 1

Hydrogen Content of Chemical Hydrides

| Compound | Wt % Hydrogen |
|---|---|
| Salt-Like Hydrides | |
| LiH | 12.68 |
| NaH | 4.20 |
| KH | 2.51 |
| RbH | 1.17 |
| CsH | 0.75 |
| $MgH_2$ | 7.66 |
| $CaH_2$ | 4.79 |
| Covalent Hydrides | |
| $LiBH_4$ | 18.51 |
| $NaBH_4$ | 10.66 |
| $KBH_4$ | 7.47 |
| $Mg(BH_4)_2$ | 11.94 |
| $Ca(BH_4)_2$ | 11.56 |
| $LiAlH_4$ | 10.62 |

TABLE 1-continued

Hydrogen Content of Chemical Hydrides

| Compound | Wt % Hydrogen |
|---|---|
| $NaAlH_4$ | 7.47 |
| $KAlH_4$ | 5.75 |
| $Li_3AlH_6$ | 11.23 |
| $Na_3AlH_6$ | 5.93 |

The chemical hydrides listed in Table 1 generate hydride or hydride-containing anionic species as long as the chemical hydrides either dissociate or are soluble in the molten salt electrolyte.

The anodic electrosynthesis reaction is preferably carried out at a temperature between 0 and 1000° C., such as a temperature between 25 and 800° C. or between 100 and 700° C., or more preferably between 300 and 600° C., although a lower temperature of between 25 and 150° C. may be desirable from an energy consumption standpoint.

Furthermore, the reaction is typically carried out at a pressure between 1 and 250 atmospheres, preferably between 1 and 100 atmospheres, more preferably between 1 and 50 atmospheres, even more preferably between 1 and 20 atmospheres, and most preferably up to 5 atmospheres, including atmospheric pressure. The electrochemical cell can be pressurized using the reactant gases (nitrogen and hydrogen), but the internal pressure of the cell must be prevented from exceeding the pressure at which the reactant gases are supplied to the cathode in order to prevent backflow of molten salts into the porous electrodes or failure of the electrodes within the cell.

Once the cell has been assembled and heated to the operational temperature and pressure, then a constant voltage is applied between the anode and cathode. The preferred voltage is up to 2 Volts, up to 1 Volt, or up to 0.5 Volts. It is also preferred to apply a constant current density between the anode and the cathode of up to 2 $A/cm^2$, up to 1 $A/cm^2$, up to 0.3 $A/cm^2$, or up to 0.1 $A/cm^2$. In the preferred embodiment, nitrogen gas and hydrogen gas are introduced at the cathode.

Figure 1A:
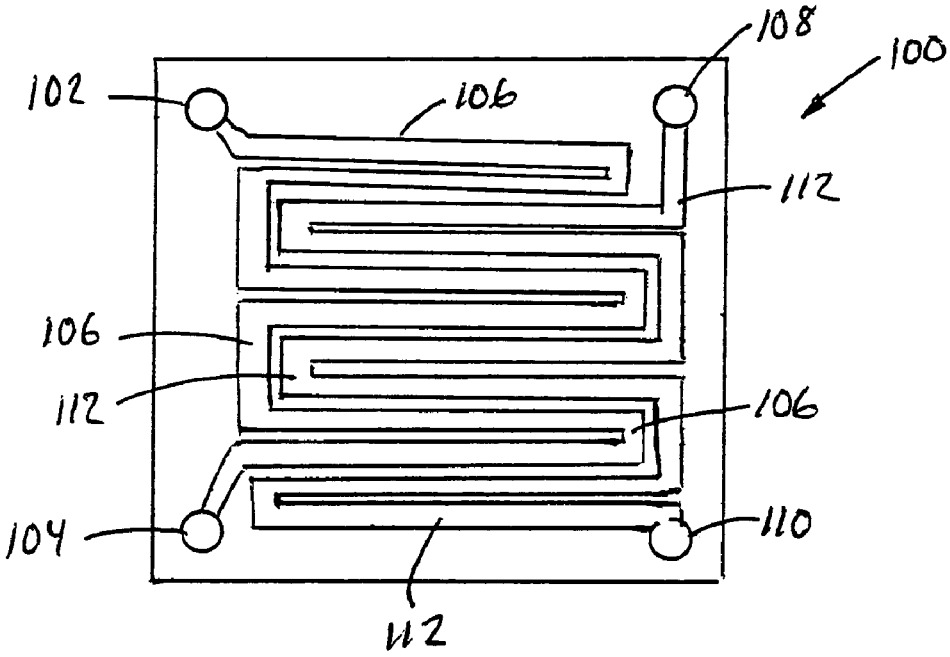
FIG. 1A is a schematic diagram of an endplate or bipolar plate having dual serpentine flow channels for flowing nitrogen gas and hydrogen gas through separate channels as an alternative to the common flow channels of the endplate of FIG. 1.

FIG. 1A is a schematic diagram of a face of an endplate or bipolar plate 100 having nitrogen inlet/outlet manifolds 102,104 in fluid communication with a serpentine flow channel 106 for flowing nitrogen gas over the cathode and hydrogen inlet/outlet manifolds 108,110 in fluid communication with a separate serpentine flow channel 112 for flowing hydrogen gas over the cathode. This dual serpentine flow channel configuration allows nitrogen gas and hydrogen gas to flow through separate channels as an alternative to the common flow channels 23 of the endplate 16 in FIG. 1. It may be beneficial to maintain some separation of the nitrogen and hydrogen gases to avoid ammonia gas generation reactions from occurring at the cathode, since this could lead to electrolyte breakdown and the generation of impurities released into the ammonia product stream. Furthermore, recovery of any significant quantity of ammonia in the cathode recycle stream would require additional separation steps and equipment. Additional measures can be taken to avoid ammonia production at the cathodes, as will be described later with respect to FIGS. 3, 3A and 4.

Figure 2:
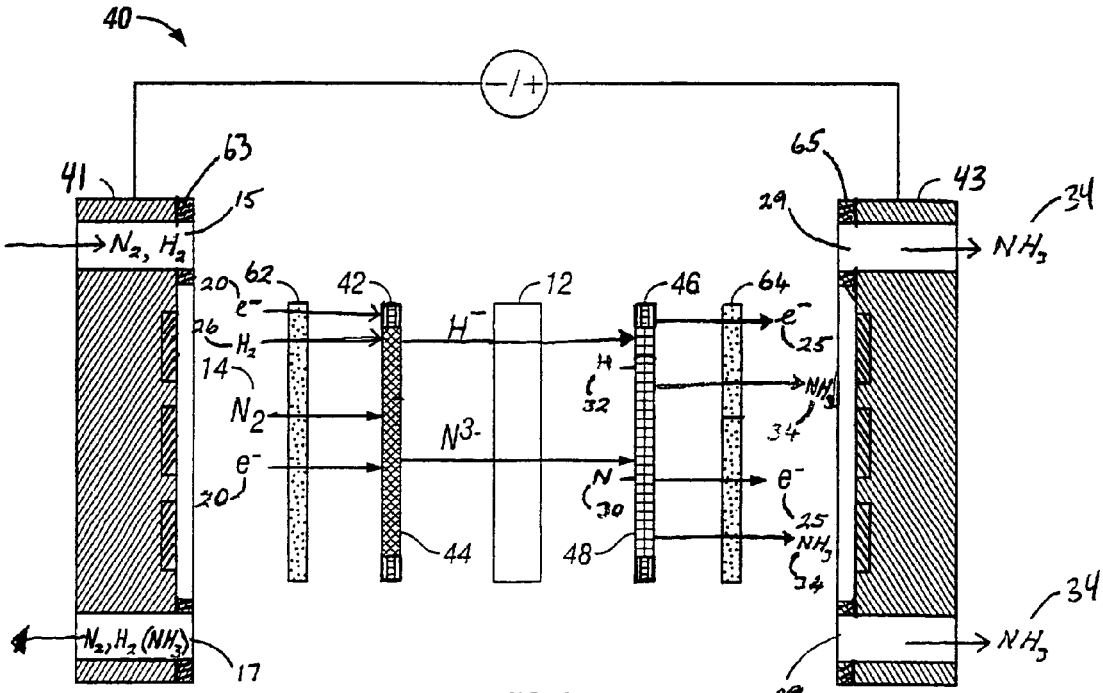
FIG. 2 is an expanded schematic flow diagram of a second ammonia electrosynthesis cell having porous anode and cathode flowfields.

FIG. 2 is an expanded schematic flow diagram of an ammonia electrosynthesis cell 40 in accordance with a second embodiment of the present invention. The cell 40 operates in almost identical fashion to cell 10 of FIG. 1, except that it includes a catalyzed gas diffusion electrode or a catalyzed backing electrode 42 in combination with a porous electrically conducting cathode flow field 62 and a catalyzed gas diffusion electrode or a catalyzed backing electrode 46 in combination with a porous electrically conducting anode flow field 64. A cathode flow field frame 63 encompasses the perimeter of the cathode flow field 62 and makes a leak free seal with the endplate 41. A similar frame (not shown) surrounds the cathode electrode 42/electrolyte-matrix combination 12/anode electrode 46 assembly. The cathode gas manifolds 15 and 17 in cathode endplate 41 are in fluid communication with the cathode flow field 62. Similarly, an anode flow field frame 65 encompasses the perimeter of the anode flow field 64 and makes a leak free seal with the endplate 43. The anode gas manifolds 29 in anode endplate 43 are in fluid communication with the anode flow field 64.

Figure 3A:
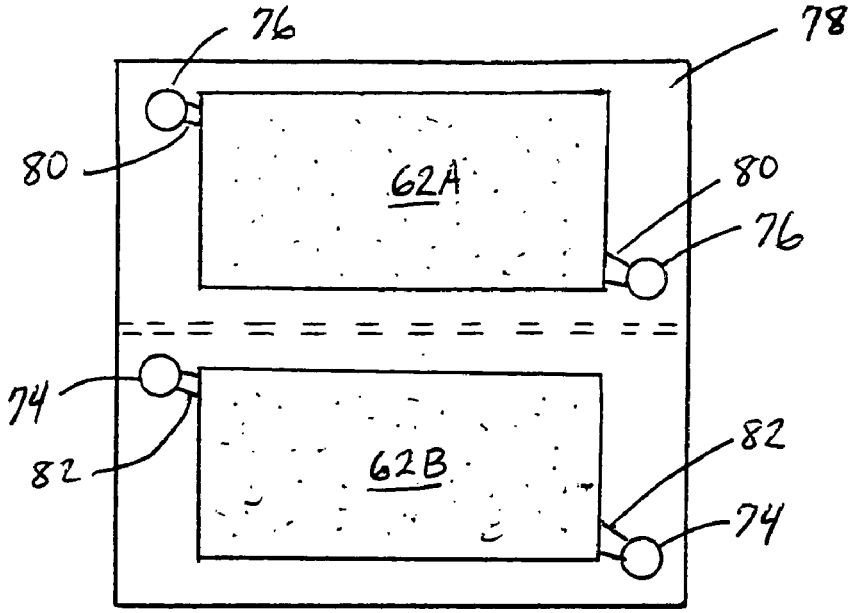
FIG. 3A is a schematic diagram of a porous flowfield and frame consistent with the cell of FIG. 3.
Figure 3:
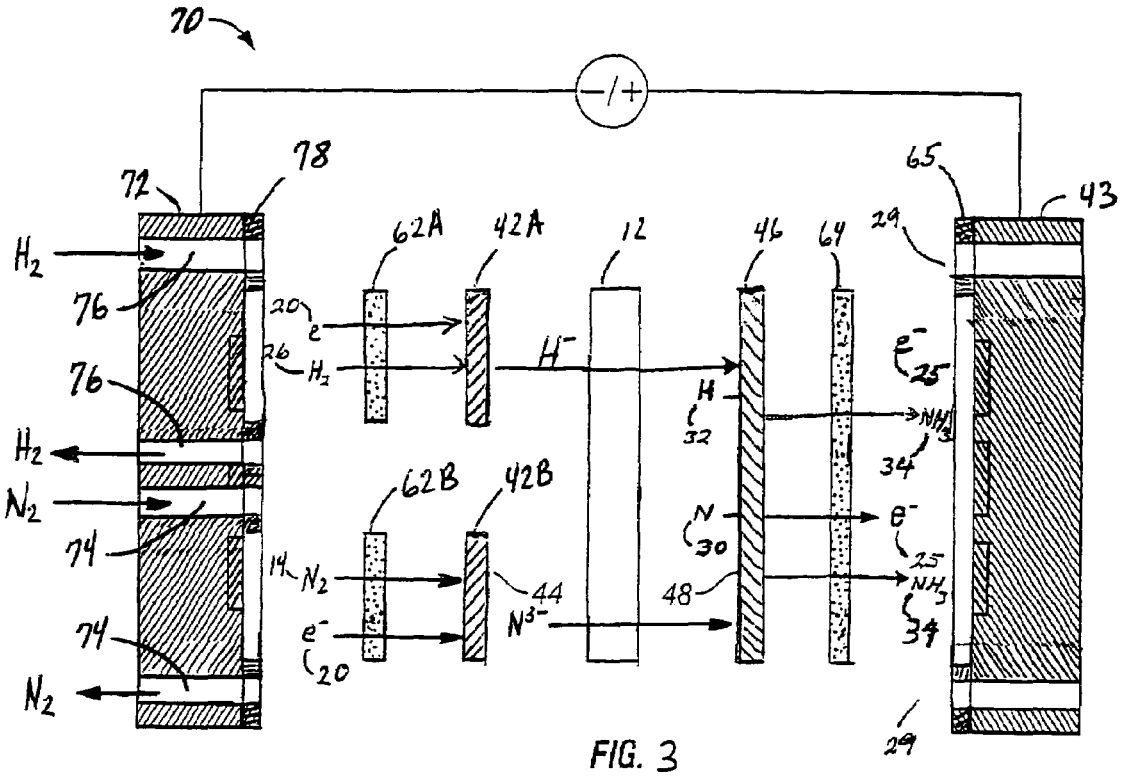
FIG. 3 is an expanded schematic flow diagram of a third ammonia electrosynthesis cell having separate nitrogen gas and hydrogen gas manifolds, flowfields, and electrode substrates.

FIG. 3 is an expanded schematic flow diagram of an ammonia electrosynthesis cell 70 in accordance with a third embodiment of the invention. The cell 70 has an cathodic endplate 72 with nitrogen gas inlet/outlet manifolds 74 that are separate from the hydrogen gas inlet/outlet manifolds 76. Furthermore, the hydrogen and nitrogen manifolds 76,74 communicate the gases to separate flow fields 62A, 62B, respectively, and, in turn, to separate electrode substrates 42A,42B, respectively. As discussed previously with respect to FIG. 1A, it may be beneficial to maintain some separation of the reactant gases to avoid ammonia generation at the cathode. Thise endplate 72 illustrates an alternative configuration to maintain that separation, but also facilitates the use of the separate flow fields and electrode substrates. In this manner, the overall cathode surface area is effectively split to provide a hydrogen cathode and a nitrogen cathode. Having the separate hydrogen cathode substrate 42A and nitrogen cathode substrate 42B provides some degree of separation of the hydride and nitride ions and prevents immediate ammonia generation at the cathode. While FIG. 3 shows a unitary electrolyte matrix 12, it is envisioned that some or all of the electrolyte matrix might also be split to maintain the separation of the hydride and nitride ions to a greater extent. However, at some point the hydride and nitride ions must be allowed to interact at the surface of the anode 46.

Having separate cathode substrates 42A,42B, facilitates each substrate being made from different materials that are optimal for the functions and conditions of the electrode. For example, the nitrogen reduction electrode preferably includes a nickel or nickel alloy substrate, because these materials do not form nitride compounds. Similarly, a preferred hydrogen reduction electrode substrate includes molybdenum or molybdenum alloys, because these materials do not absorb hydrogen. The selection of separate catalysts is also facilitated.

FIG. 3A is a schematic diagram of a face of a frame 78 and porous flowfields 62A,62B consistent with the cell 70 of FIG. 3. The frame has passages for the nitrogen gas inlet/outlet manifolds 74 and for the hydrogen gas inlet/outlet manifolds 76. These manifolds 76,74 communicate with the flowfields 62A,62B via channels 80,82, respectively. The channels 80,82 may be cut partially or fully through the thickness of the frame 78.

Figure 4:
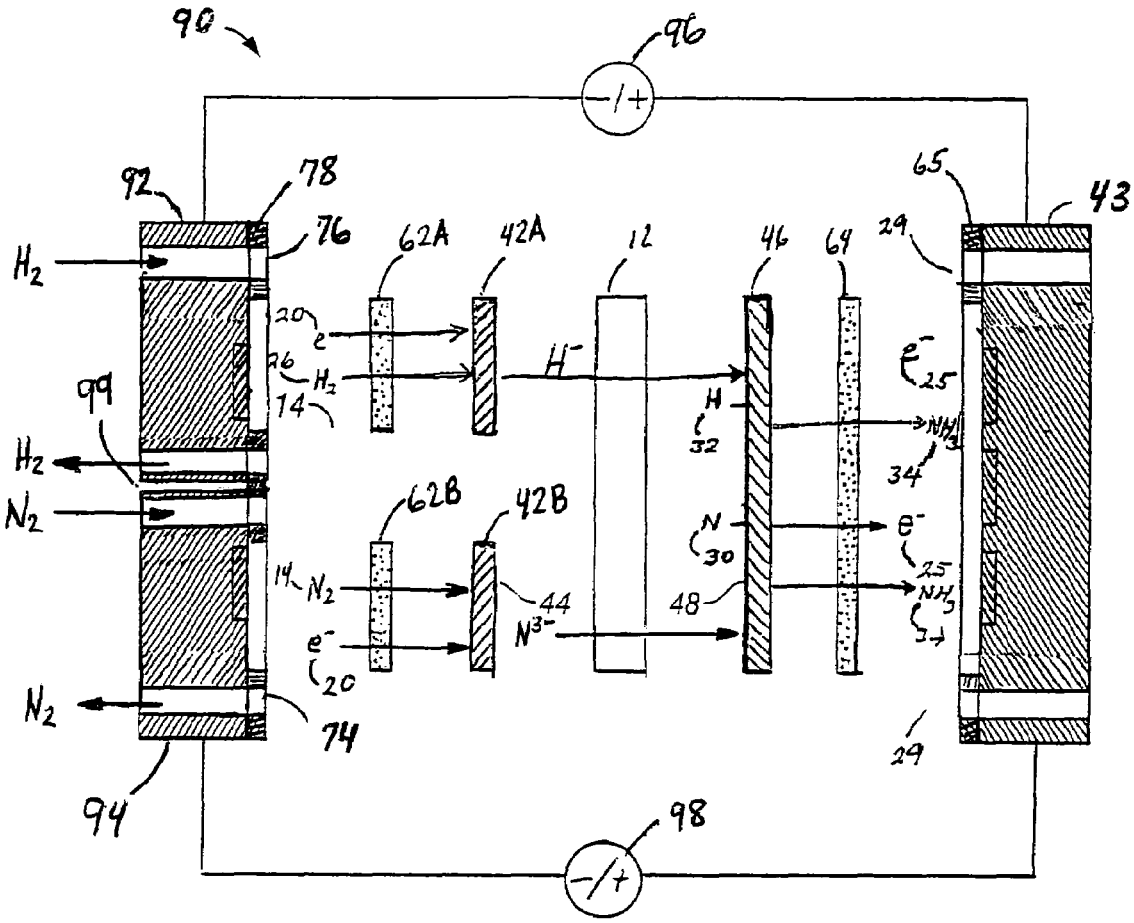
FIG. 4 is an expanded schematic flow diagram of a fourth ammonia electrosynthesis cell having two half cathodes coupled to separate power supplies.

FIG. 4 is an expanded schematic flow diagram of another ammonia electrosynthesis cell 90 in accordance with a fourth embodiment of the invention, the cell 90 having two half cathodes enplates 92,94 coupled to separate power supplies 96,98, respectively. Two half cathodes are formed by the combinations of the endplates 92,94, the flowfields 62A,62B, and the electrode substrates 42A,42B, respectively. While cell 90 have many similarities with cell 70, the endplates 92,94 are electrically isolated by an insulative flowfield frame 78 can be made in the same manner as in FIG. 3, preferably with the insulator element 99 being an insulative material to provide support for the adjacent central portion of the frame 78. An electronically insulative frame would also be placed around the cathode substrates 42A,42B (not shown) to maintain electrical isolation of the two cathode substrates. Accordingly, the electronic potential or voltage of the two half cathodes can be separately controlled to further optimize the generation of hydride and nitride ions.

Figure 5:
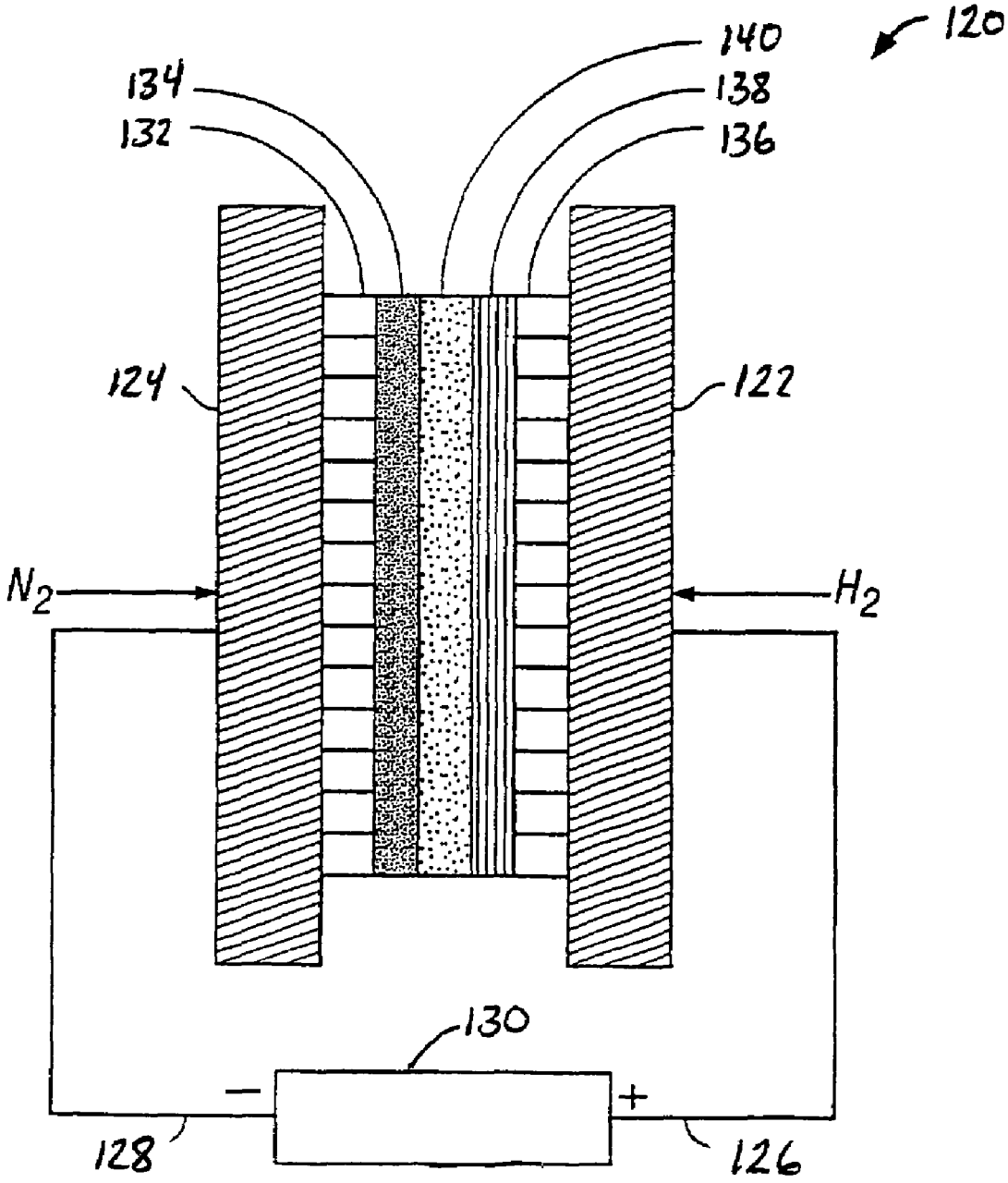
FIG. 5 is a schematic structural diagram of an ammonia electrosynthesis cell stack.

FIG. 5 is a schematic structural diagram of an ammonia electrosynthesis cell or reactor 120. The reactor 120 includes an anode endplate 122 and a cathode endplate 124 that secure the cell components together and are coupled to the positive terminal 126 and negative terminal 128 of a power supply 130, respectively. An anode flow field 136 is provided to remove ammonia formed from the porous anode 138. Similarly, a cathode flow field 132 is provided to distribute nitrogen gas and hydrogen gas over the porous cathode 134. An electrolyte contained in a sheet-like porous matrix material 140 is disposed between the porous anode and the porous cathode. Many important factors, such as materials compatibility, electrolyte loss, and operating conditions have been well developed for working in the aggressive environment associated with molten salts and will be known to those of ordinary skill in the art. Also, the design of the electrochemical cell allows for minimum ohmic losses in the system that leads to a reduction of power consumption. All of the frames and manifolds are not shown in schematic of FIG. 5, but would ordinarily be provided in a manner known well in the art.

Ionic Liquids or Room Temperature Molten Salts

Ionic liquids are generally regarded as beginning with the first reported synthesis of ethylammonium nitrate ($[H_3CH_2CNH_3]^+[NO_3]^-$) in 1914. This species was formed by the addition of concentrated nitric acid to ethylamine, after which water was removed by distillation to give the pure salt, which was liquid at room temperature with a melting point of 12° C. However, intensive research on ionic liquids only began in recent years, primarily driven by the need for more environmentally benign solvents. Ionic liquids are often defined as salts with a melting temperature below the boiling point of water. This arbitrary definition based on temperature says little about the composition of the materials, except that they are completely ionic. Thus, other synonyms commonly used for ionic liquids include: "room-temperature molten salt", "low-temperature molten salt", "ambient-temperature molten salt", and "liquid organic salt." However, the consensus in most literature reports is to use the term ionic liquid as the accepted nomenclature.

The general chemical composition of ionic liquids is surprisingly consistent, even though the specific composition and the chemical and physical properties vary tremendously. Most ionic liquids have an organic cation and an inorganic polyatomic anion. Generally one or both ions are large, having greater than 10 atoms per ion, and the cation will have a low degree of symmetry. These factors tend to reduce the lattice energy of the crystalline form of the salt, and hence lower the melting point. Since there are many known and potential cations and anions, the potential number of ionic liquids is huge. Ionic liquids come in two main categories: simple salts made of a single anion and cation and binary ionic liquids where an equilibrium is involved. Ethylammonium nitrate is an example of a simple salt, whereas mixtures of aluminum(III)chloride and 1,3-dialkylimidizolium chlorides form a binary ionic liquid system. Binary ionic liquids contain several different ionic species and their melting point and properties depend upon the mole fractions of the component species present in the salt. The archetypal system that has been studied extensively for binary ionic liquids is [EMIM]Cl-$AlCl_3$ (EMIM=1-ethyl-3-methylimidazolium).

Ionic liquids have been described as designer solvents, and this means that their properties can be adjusted to suit the requirements of a particular process. Properties such as melting point, viscosity, density, and hydrophobicity, can be varied by simple changes to the structure of the ions. For example, the melting points of 1-alkyl-3-methylimidizolium tetrafluoroborates and hexafluorophosphates are a function of the length of the 1-alkyl group, and form liquid crystalline phases for alkyl chain lengths over 12 carbon atoms. Another important property that changes with structure is the miscibility of water in these ionic liquids. For example, 1-alkyl-3-methylimidazolium tetrafluoroborate salts are miscible with water at 25° C. where the alkyl chain length is less than 6, but at or above 6 carbon atoms, they form a separate phase when mixed with water.

The most common ionic liquids are based on alkylammonium, alkylphosphonium, N-alkylpyridinium, N-alkylimidazolium (or N,N'-dialkylimidazolium) cations and their derivatives with various anions. Other classes include pyrrolidinium, guanidinium, isouronium-based derivatives, and halogenoaluminate (III) or alkylhalogenoaluminate (III) type ionic liquids. The basic structure of imidizolium based ionic liquids is shown below.

Structure of Imidizolium based ionic liquids. The R groups can be hydrogen or hydrocarbon groups. In general, at least one nitrogen must be substituted for the compound to be a "room temperature" ionic liquid. The counterion $X^-$ can be any of a number of anions.

The imidizolium-based ionic liquids can have varying degrees of substitution from mono-substitution to tri-substitution, in which all three R positions are occupied by an organic group. The counterion can be any of a number of common anions from halides to tetrafluoroborate to trifluoromethanesulfonate (to name a few). The degree and type of substitution effects the chemical and physical properties of the ionic liquids. However, this class is both water and air stable and are completely non-volatile rendering them ideally suited for electrolytic applications. A few ionic liquids which may be suitable as an electrolyte for the low temperature anodic electrochemical synthesis of ammonia are listed in Table 2.

TABLE 2

Structure and Characteristics of Representative Ionic Liquids Suitable for Use in the Low Temperature Anodic Electrochemical Synthesis of Ammonia.

| Compound | Formula | Melting Point ° C. | Decomposition Point ° C. |
|---|---|---|---|
| 1-ethyl-3-methylimidazolium chloride | $C_6H_{11}ClN_2$ | 77 | 281 |
| 1-butyl-3-methylimidazolium chloride | $C_8H_{15}ClN_2$ | 45 | — |
| 1-hexyl-3-methylimidazolium chloride | $C_{10}H_{19}ClN_2$ | Liquid at RT | 170 |
| 1-butyl-3-methylimidazolium hexafluorophosphate | $C_8H_{15}F_6N_2P$ | 7.8 | 370 |

TABLE 2-continued

Structure and Characteristics of Representative Ionic Liquids Suitable for Use in the Low Temperature Anodic Electrochemical Synthesis of Ammonia.

| Compound | Formula | Melting Point ° C. | Decomposition Point ° C. |
|---|---|---|---|
| 1-ethyl-3-methylimidazolium tosylate | $C_{13}H_{18}N_2O_3S$ | 60 | — |
| 1-butyl-4-methylpyridinium hexafluorophosphate | $C_{10}H_{16}F_6NP$ | 45 | — |
| 1-butyl-4-methylpyridinium tetrafluoroborate | $C_{10}H_{16}BF_4N$ | 26 | 342 |
| 1-ethyl-3-methylimidazolium hexafluorophosphate | $C_6H_{11}F_6N_2P$ | 60 | 481 |

The terms "comprising," "including," and "having," as used in the claims and specification herein, shall be considered as indicating an open group that may include other elements not specified. The term "consisting essentially of," as used in the claims and specification herein, shall be considered as indicating a partially open group that may include other elements not specified, so long as those other elements do not materially alter the basic and novel characteristics of the claimed invention. The terms "a," "an," and the singular forms of words shall be taken to include the plural form of the same words, such that the terms mean that one or more of something is provided. For example, the phrase "a solution comprising a phosphorus-containing compound" should be read to describe a solution having one or more phosphorus-containing compound. The terms "at least one" and "one or more" are used interchangeably. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. It is intended that this foregoing description is for purposes of illustration only and should not be construed in a limiting sense. Only the language of the following claims should limit the scope of this invention.

What is claimed is:

1. A method comprising:

providing a nonaqueous liquid electrolyte between an anode and a porous cathode substrate;

delivering hydrogen gas through the porous cathode substrate;

reducing the hydrogen gas at the cathode to produce negatively charged hydrogen-containing species in the electrolyte;

electrochemically oxidizing negatively charged nitrogen-containing species present in the electrolyte at the anode to form atomic nitrogen species;

electrochemically oxidizing the negatively charged hydrogen-containing species present in the electrolyte at the anode to form atomic hydrogen species; and reacting the atomic hydrogen species with the atomic nitrogen species to form ammonia.

2. The method of claim 1, wherein the negatively charged nitrogen-containing species is a nitride ion.

3. The method of claim 1, wherein the negatively charged nitrogen-containing species is an azide ion.

4. The method of claim 1, wherein the step of reacting is carried out at a temperature between 25 and 800 Celsius.

5. The method of claim 1, wherein the step of reacting is carried out at a pressure between 1 and 250 atmospheres.

6. The method of claim 1, further comprising:

reducing nitrogen gas at the cathode to produce the negatively charged nitrogen-containing species in the electrolyte.

7. The method of claim 6, further comprising:

delivering the nitrogen gas through the porous cathode substrate.

8. The method of claim 7, wherein the nitrogen gas contains less than 1000 ppm moisture.

9. The method of claim 7, wherein the porous cathode has a pore size of about 0.2 microns.

10. The method of claim 1, further comprising:

supplying a nitrogen-containing salt into the electrolyte to provide the negatively charged nitrogen-containing species.

11. The method of claim 1, wherein the electrolyte comprises a molten salt.

12. The method of claim 11, further comprising:

charging the molten salt with a nitride salt.

13. The method of claim 11, further comprising:

charging the molten salt electrolyte with a nitride compound, an azide compound, or a combination thereof.

14. The method of claim 1, wherein the electrolyte comprises a salt dissolved in an organic solvent.

15. The method of claim 1, further comprising:

maintaining an inert atmosphere over the electrolyte.

16. A method comprising:

delivering nitrogen gas and hydrogen gas through a porous cathode substrate;

reducing the nitrogen gas and the hydrogen gas at the cathode to produce negatively charged nitrogen-containing species and negatively charged hydrogen-containing species;

passing the negatively charged nitrogen-containing species and the negatively charged hydrogen-containing species through a nonaqueous liquid electrolyte from the cathode to an anode;

electrochemically oxidizing the negatively charged nitrogen-containing species and the negatively charged hydrogen-containing species at the anode to form atomic nitrogen species and atomic hydrogen species; and reacting the atomic hydrogen species with the atomic nitrogen species to form ammonia.

17. The method of claim 16, further comprising:

supplying a nitrogen-containing salt into the electrolyte.

18. The method of claim 16, further comprising:

supplying a hydrogen-containing salt into the electrolyte.

* * * * *